United States Patent [19]

Chagnon et al.

[11] Patent Number: 4,924,578

[45] Date of Patent: May 15, 1990

[54] ADAPTOR TO CONVERT A SCREW GUN TO A ROTARY CUTTER

[76] Inventors: Kevin C. Chagnon, 455 E. Main St., Stratford, Conn. 06497; Glenn W. Silkman, Silver Beach Dr., Danbury, Conn. 06811

[21] Appl. No.: 295,978

[22] Filed: Jan. 11, 1989

[51] Int. Cl.[5] ..... B24B 25/00

[52] U.S. Cl. ..... 30/500; 30/276; 51/181 R

[58] Field of Search ..... 30/500, 276; 51/181 R, 51/170 PT

[56] References Cited

U.S. PATENT DOCUMENTS

| | | | |
|---|---|---|---|
| 1,785,065 | 12/1930 | Aborn | 30/377 |
| 2,133,237 | 10/1938 | Streby | 51/181 |
| 2,346,220 | 4/1944 | Kienzle et al. | 73/864.44 |
| 3,260,289 | 7/1966 | Whitten, Jr. | 30/392 |
| 3,783,955 | 1/1974 | Gill | 173/48 |
| 4,052,078 | 10/1977 | Benimetzki | 279/93 |
| 4,082,475 | 4/1978 | Kuder | 30/500 |
| 4,312,610 | 1/1982 | Burt | 408/26 |
| 4,841,643 | 6/1989 | Colella | 30/500 |

*Primary Examiner*—Frank T. Yost
*Assistant Examiner*—Tom Hamill, Jr.
*Attorney, Agent, or Firm*—St. Onge, Steward, Johnston & Reens

[57] ABSTRACT

The present invention relates to an adaptor for converting a rotary power tool with a driving bit to a rotary cutter. The adaptor is particularly useful for making a conventional rotary screw gun into a gypsum wall board cutter. On one end of the adaptor is a rotary cutting bit, while a flexible open-ended bulb is fitted on the other end of the adaptor to receive the front end of the screw gun from which the screw driving bit extends. Between the bulb and the rotary cutting bit is a casing for housing a power transmission mechanism which transfers torque from the screw driving bit to the rotary cutting bit. The power transmission mechanism includes a plurality of rotatable gears and shafts to enable the cutting bit to turn at a speed preferably six times greater than that of the screw driving bit of the screw gun. The adaptor is operatively engaged with and disengaged from the screw gun without clamping or unclamping the adaptor to the screw gun. Instead, the adaptor is simply moved toward or away from the screw gun to achieve relative engagement or disengagement, respectively. The adaptor also eliminates the need for a separate rotary power tool for cutting gypsum wall board which is often used by carpenters in addition to a rotary screw gun to install gypsum wall board.

13 Claims, 2 Drawing Sheets

ADAPTOR TO CONVERT A SCREW GUN TO A ROTARY CUTTER

BACKGROUND OF THE INVENTION

In completing building construction projects, it is often necessary to install pieces of gypsum wall board or dry wall within the building. When gypsum wall board is installed, holes must frequently be cut in it to accommodate electrical switches and outlets, windows, etc. Consequently, carpenters installing gypsum wall board have had to employ power tools to: (1) drive screws through gypsum wall board and into the frame of the building and (2) cut holes in gypsum wall board for the electrical light switches and outlets, etc. Generally, the tools which have been used for these operations are a power rotary screw gun (e.g., MILWAUKEER® Screw-Shooter Nos. 6750-1 or 6753-1) for driving the screws into the gypsum wall board and a separate power rotary cutter (e.g., a router with a rotary cutting bit). When not in use, these tools clutter the job site, and their power cables may create safety hazards. Moreover, when a carpenter is using one of the power tools and needs the other, he must walk away from where he is working to retrieve the other power tool. The use of two power tools to install gypsum wall board is thus inefficient, and, therefore, it is desirable to install gypsum wall board with a single power tool.

Adaptors to convert rotary power tools from one function to another function are well known. However, such adaptors generally must be physically clamped to the power tool by insertion and locking engagement with a chuck or by clamping to a drill bit already in a power tool chuck. Examples of such adaptors are disclosed by U.S. Pat. No. 1,785,065 to Aborn, U.S. Pat. No. 2,346,220 to Kienzle et al., U.S. Pat. No. 3,260,289 to Whitten, Jr., U.S. Pat. No. 3,783,955 to Gill, U.S. Pat. No. 4,052,078 to Benimetzki, U.S. Pat. No. 4,082,475 to Kuder, and U.S. Pat. No. 4,312,610 to Burt. Such devices do not, however, convert screw guns to gypsum wall board cutters. Moreover, these devices are unsatisfactory, because significant time and effort is required to clamp and unclamp these devices to and from a rotary power tool. Thus, the devices disclosed by these patents fail to satisfy the need for an adaptor which can be operatively oriented in rapid fashion with respect to a screw gun or other similar rotary power tool.

SUMMARY OF THE INVENTION

The present invention satisfies the need for an adaptor to convert a screw gun to a gypsum wall board cutter. In addition, the adaptor can be moved into and out of operative engagement with the screw gun without clamping or unclamping the adaptor to the screw gun. As a result, the adaptor can be quickly positioned on the front end of a screw gun to cut a hole in a piece of gypsum wall board and then removed to drive the screws into the gypsum wall board. The small size of the adaptor makes it suitable for placement in a carpenter's pocket or workbelt when not in use. However, when it is necessary to cut gypsum wall board, the adaptor can be quickly placed on the end of a screw gun without requiring the carpenter to leave the location where he is working. In addition, the adaptor of the present invention eliminates the need for a second rotary power tool which lays around the construction site where workers can trip over it or its accompanying power cable. Consequently, construction safety is greatly enhanced.

The adaptor of the present invention includes a casing having one end from which a rotary cutting bit extends and another end from which an open-ended bulb projects to receive the screw gun. When a screw gun is operatively engaged with the adaptor, the screw driving bit of the screw gun is inserted into a screw head, while the end of the bulb abuts against the sleeve of the screw gun. To cut gypsum wall board efficiently, the rotary cutter of the adaptor must turn at a much higher speed than that of a screw gun. This result is achieved by providing a plurality of gears and bearing-mounted shafts within the casing which increase the rotary speed of the screw gun four to ten fold. These gears, shafts, and bearings are accessed by constructing the casing from two pieces which are separable at a location adjacent these transmission components.

DETAILED DESCRIPTION OF THE DRAWINGS

Figure 1:
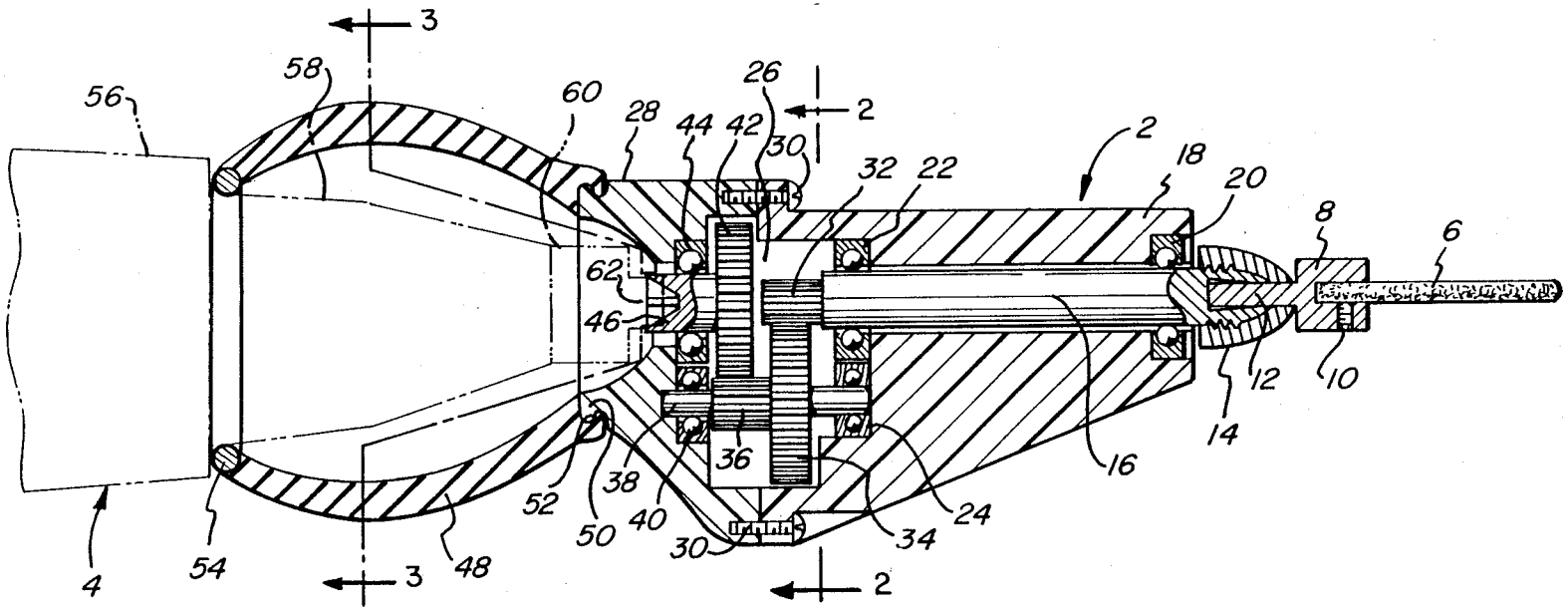
FIG. 1 is a side cross-sectional view of the adaptor of the present invention.

FIG. 1 is a side cross-sectional view of adaptor 2 of the present invention for converting screw gun 4 to a rotary cutter. Rotary cutting is accomplished by cutting bit 6 which is clamped within cutting bit chuck 8 by screw 10. Tang 12 of chuck 8 is clamped to main shaft 16 by nut 14 which is threadably-mounted on the end of shaft 16.

Figure 2:
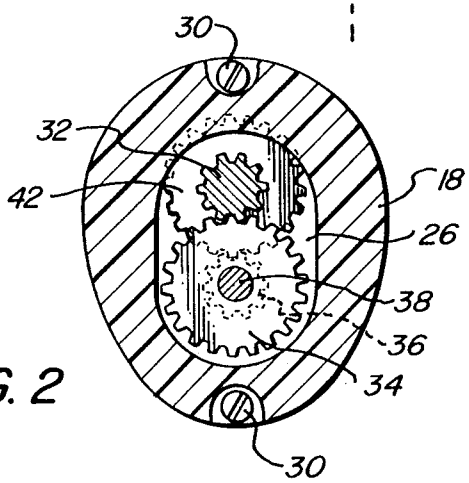
FIG. 2 is a cross-sectional view of the present invention taken along line 2—2 of FIG. 1.

The bulk of screw gun adaptor 2 is a casing formed from upper housing 18 and lower housing 28 which are separably joined by screws 30. Extending through upper housing 18 is main shaft 16 which is rotatably mounted on bearings 20 and 22. Upper housing 18 and lower housing 28 define an interior transmission chamber 26 containing gears 32, 34, 36, and 42. Gear 32 is coaxially mounted to the end of main shaft 16 and has teeth operatively engaged with the teeth of gear 34. Gear 34 and gear 36 are coaxially mounted on shaft 38 which is rotatably supported by bearings 24 and 40. Gear 36 has teeth which are operatively engaged with those of gear 42. Gear 42 is coupled to drive head 46 which is rotatably supported by bearing 44. The interengagement of the teeth of gear 36 with those of gear 42 and the similar engagement of the teeth of gear 32 with the teeth of gear 34 is shown in FIG. 2.

Extending from the end of adaptor 2 opposite to cutting bit 6 is a flexible rubber bulb 48 which is connected to lower housing 28 by interengagement between housing lock member 50 and bulb lock member 52. The distal end of bulb 48 ends at terminating ring 54.

Figure 3:
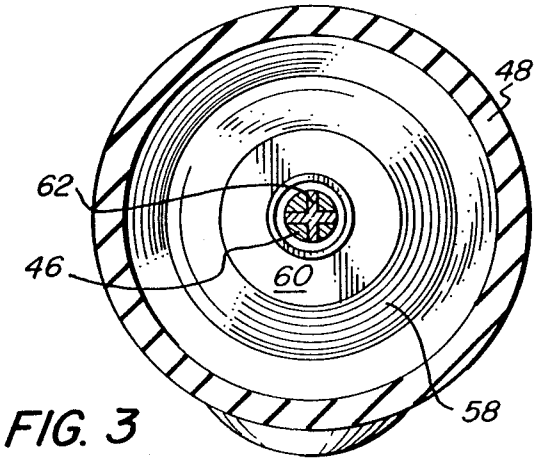
FIG. 3 is a cross-sectional view of the present invention taken along line 3—3 of FIG. 1.

When screw gun 4 is operatively engaged with adaptor 2, locator 58, chuck 60, and screw driving bit 62 are inserted within the hollow interior of bulb 48 with a Phillips head screw driving bit 62 operatively received by Phillips drive element head 46. A cross-sectional view of the engagement between adaptor 2 and screw gun 4 along line 3—3 of FIG. 1 is shown in FIG. 3. Terminating ring 54 abuts against sleeve 56 of screw gun 4. Bulb 48 is capable of operatively engaging screw guns having a locator 58 and a chuck 60 of varying lengths. For screw guns with a short locator and/or chuck, bulb 48 is longitudinally compressed (i.e., terminating ring 48 moves closer to lock member 52) so that screw driving bit 62 fits into drive element head 46. For screw guns with longer locators and/or chucks, bulb 48 will be subjected to less compression when utilizing the adaptor.

Figure 4:
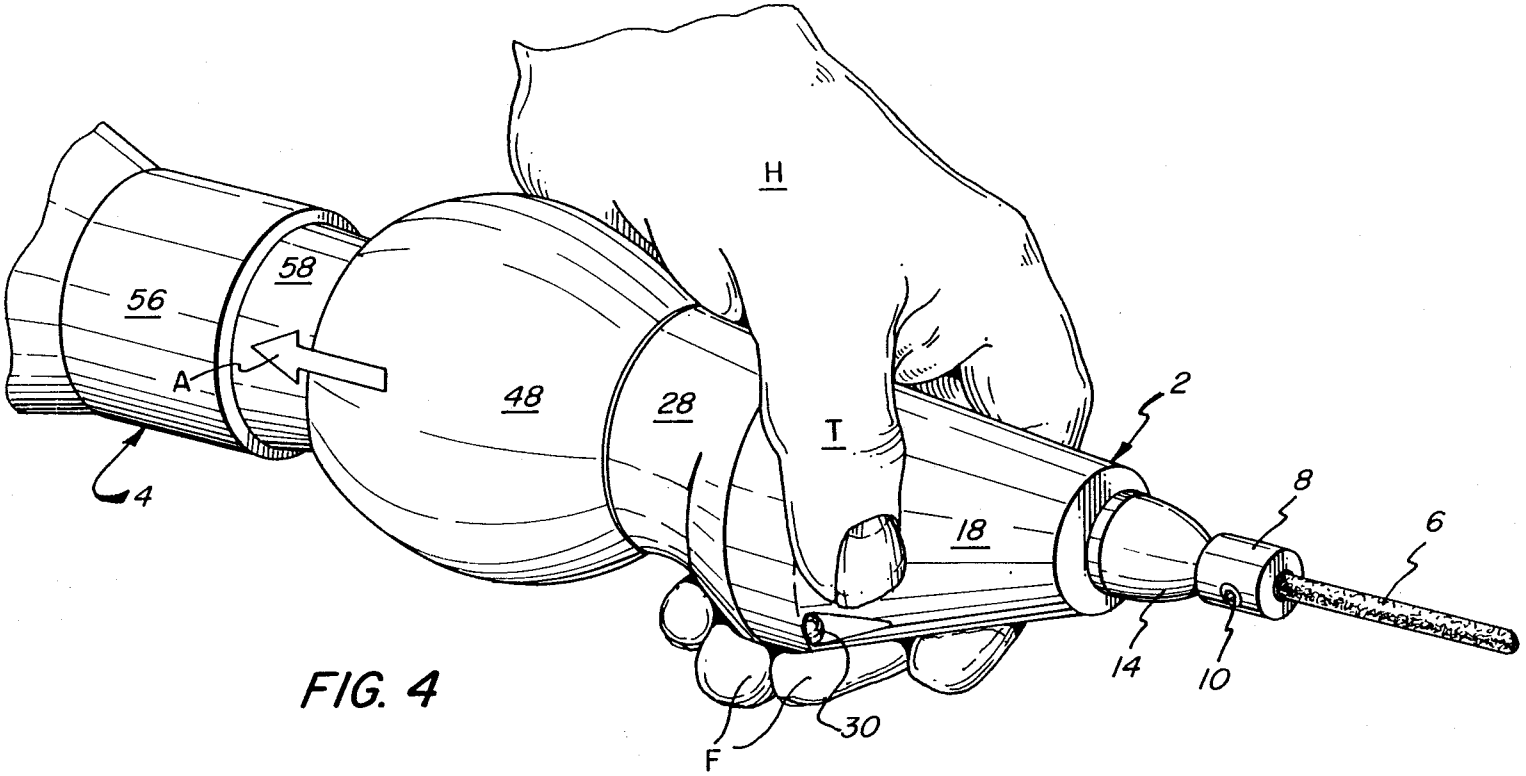
FIG. 4 is a perspective view of the present invention in use.

FIG. 4 is a perspective view of the adaptor of the present invention in use. When it is desired to operatively engage adaptor 2 with screw gun 4, the casing formed by upper housing 18 and lower housing 28 is grasped between thumb T and fingers F of hand H and moved toward screw gun 4 in the direction of arrow A. After ring 54 of bulb 48 abuts sleeve 56, as shown in FIG. 1, movement of the adaptor in the direction of arrow A compresses bulb 48 longitudinally until screw driving bit 62 is fitted within drive head 46. When adaptor 2 is in this position, operation of screw gun 4 turns rotary cutting bit 6. During such periods of operation, adaptor 2 is maintained in operative engagement with screw gun 4 by using hand H to hold adaptor 2 in engagement with screw gun 4. When cutting is completed and it is desired to use screw gun 4 for its conventional purpose of driving screws, adaptor 2 can be moved out of operative engagement with screw gun 4 by grasping the casing formed by upper housing 18 and lower housing 28 between thumb T and fingers F of hand H and moving it in a direction opposite arrow A. After adaptor 2 is moved off the end of screw gun 4, the adaptor can be placed in a carpenter's pocket or tool belt for subsequent use.

Internally, when adaptor 2 is operatively engaged with screw gun 4, screw driving bit 62 is fitted into Phillips head drive element 46 such that rotation of screw driving bit 62 turns drive element 46 and, therefore, gear 42. The turning of gear 42 causes gear 36 to rotate by virtue of their interengaging teeth. The rotation of gear 36 imparts rotation to gear 34, because both are commonly and coaxially mounted on shaft 38. The teeth of gears 34 and 32 are in interengagement so that rotation of gear 34 causes gear 32 to turn. The turning of gear 32 ultimately rotates cutting bit 6 by virtue of their being mounted on a common shaft 16. Rotation of these parts is facilitated by mounting drive head 46 on bearing 44, shaft 38 on bearings 40 and 24, and shaft 16 on bearings 20 and 22. By virtue of their difference in diameter, gears 36 and 32 rotate two to five times, preferably three times, faster than gears 42 and 34, respectively. Since gears 32, 34, 36, and 42 operate in a serial fashion, the net effect of this rotational speed variation causes rotary cutting bit 6 to turn four to ten times, preferably six times, faster than screw driving head 62. Adaptor 2 enables screw gun 4 to cut holes in gypsum wall board even though the screw gun's rotational speed is insufficient to effect such cutting.

Although the invention has been described in detail for the purpose of illustration, it is understood that such detail is solely for that purpose, and variations can be made therein by those skilled in the art without departing from the spirit and scope of the invention which is defined by the following claims.

We claim:

1. An adaptor for converting a rotary power tool having an axis of rotation with a rotating driving bit to a tool with a rotating cutter, comprising:

a rotatable driven element;

power transmission means for transferring rotational movement of said driven element to said cutter for rotation thereof;

a casing to which the power transmission means and the driven element are mounted said casing having an end with an opening through which operative contact between the driving bit and the driven element is obtained;

axially compressible and expandable support means mounted to the power tool for holding the casing; said support means extending towards the driving bit to terminate at a locking end that is shaped to receive and releasably-retain said casing end; said support means being compressible to vary the position of the locking end along the axis of rotation whereby said driven element engages the driving bit when the support is axially-compressed and said driven element is released from the driving bit when the support means is axially expanded.

2. An adaptor according to claim 1, wherein said support means comprises:

a flexible bulb having opposing ends, each end having an opening, with one end of the bulb connected to said casing end and the other opposite open end being shaped for mounting to the power tool.

3. An adaptor according to claim 2 wherein the bulb further comprises:

a terminating ring at the one open end of said bulb for abutting mounting contact with the power tool.

4. An adaptor according to claim 1, wherein said power transmission means comprises:

a first large diameter gear attached to and coaxial with said rotatable driven element and a first small diameter gear of smaller diameter than the first large gear and drivingly coupled both said first large diameter gear and said cutter, whereby rotation of the power tool, when the driving bit is in operative contact with the driven element causes rotation of said cutter at a faster rate than the driving bit.

5. An adaptor according to claim 4, wherein said power transmission means further comprises:

a second large diameter gear mounted on a common shaft with said first small diameter gear and a second small diameter gear having a smaller diameter than the second large diameter gear and drivingly coupled to both said second large diameter gear and said cutter.

6. An adaptor according to claim 5, wherein the ratios of the diameters of the gears are selected so that said cutter turns four to ten times faster than the driving bit.

7. An adaptor according to claim 5, and further including bearing means for rotatably supporting said rotatable driven element and the common shaft.

8. An adaptor according to claim 1, wherein said rotatable driven element is a screw head and the driving bit is a screw driving bit interengagable with said screw head.

9. An adaptor for converting a rotary power tool having an axis of rotation with a rotating screw driver bit to a tool with a rotating cutter, comprising:

a screw head for interengaging with the screw driver bit;

power transmission means coupling said screw head to said cutter for converting rotation of said screw head to rotation of the cutter at a speed that is from four to ten times faster than the screw head;

a casing from which said cutter extends and which houses said screw head, and said power transmission means, axially compressible and expandable support means for mounting to the power tool and holding the casing, said support means extending towards the driven element to terminate at a locking end that is shaped to receive and releasably-retain said casing end; said support means being compressible to vary the position of the locking end along the axis of rotation whereby said driven element engages the driving bit when the support means is axially-compressed and said driven element is released from the driving bit when the support means is axially expanded.

10. An adaptor according to claim 9, wherein said support means comprises:

a flexible bulb with one open end connected to said casing end proximate to said rotatable driven element, said bulb having an opposite open end for receiving the power tool and a terminating ring mounted to the opposite open end of said bulb for abutting contact with the power tool.

11. An adaptor for according to claim 10 and further comprising:

fastening means to attach said flexible bulb to said casing.

12. An adaptor according to claim 10, wherein said power transmission includes speed increasing interengaged gears selected to cause said cutter to rotate four to ten times faster than the driving bit.

13. An adaptor according to claim 14, wherein said casing is formed of two matchline housings which can be disconnected to access said power transmission means.

* * * * *